United States Patent [19]

Entringer et al.

[11] Patent Number: 4,952,181

[45] Date of Patent: Aug. 28, 1990

[54] MARINE SHIFT CABLE ASSEMBLY WITH SPRING GUIDE

[75] Inventors: David C. Entringer, Wautoma; Terrel C. Warhurst, Oshkosh, both of Wis.

[73] Assignee: Brunswick Corporation, Skokie, Ill.

[21] Appl. No.: 242,023

[22] Filed: Sep. 8, 1988

[51] Int. Cl.[5] ..... B63H 5/13

[52] U.S. Cl. ..... 440/86; 74/DIG. 8; 123/198 DC

[58] Field of Search ..... 440/84, 86, 87, 75; 74/DIG. 8; 123/198 DC

[56] References Cited

U.S. PATENT DOCUMENTS

| | | | |
|---|---|---|---|
| 3,165,941 | 1/1965 | Morse . | |
| 4,231,316 | 11/1980 | Bland et al. | 440/86 |
| 4,262,622 | 4/1981 | Dretzka | 440/86 |
| 4,403,970 | 9/1983 | Dretzka et al. | 440/86 |
| 4,432,734 | 2/1984 | Bland | 440/86 |
| 4,525,149 | 6/1985 | Broughton | 440/86 |
| 4,531,487 | 7/1985 | Fujikawa | 123/198 DC |
| 4,753,618 | 6/1988 | Entringer | 440/86 |

FOREIGN PATENT DOCUMENTS

| | | | |
|---|---|---|---|
| 532951 | 11/1956 | Canada | 74/DIG. 8 |
| 871674 | 3/1983 | Fed. Rep. of Germany . | |

*Primary Examiner*—Joseph F. Peters, Jr.
*Assistant Examiner*—Jesus D. Sotelo
*Attorney, Agent, or Firm*—Andrus, Sceales, Starke & Sawall

[57] ABSTRACT

A shift cable assembly for a marine drive having a clutch and gear assembly (18), includes a remote control (11) for selectively positioning the clutch and gear assembly into forward, neutral and reverse, a control cable (10) connecting the remote control to a shift lever (3) pivotally mounted on a shift plate (2), a drive cable (17) connecting the shift lever on the shift plate to the clutch and gear assembly, and a spring guide assembly (100) with compression springs (101, 102, 103) biased to a loaded condition by movement of the remote control from neutral to forward and also biased to a loaded condition by movement of the remote control from neutral to reverse. The bias minimizes chatter of the clutch and gear assembly upon shifting into gear, and aids shifting out of gear and minimizes slow shifting out of gear and returns the remote control to neutral, all with minimum backlash of the cables. The spring guide assembly includes an outer tube (106) mounted to the shift plate, and a spring biased plunger (107) axially reciprocal in the outer tube and mounted at its outer end (**10*a***) to the shift lever.

10 Claims, 3 Drawing Sheets

MARINE SHIFT CABLE ASSEMBLY WITH SPRING GUIDE

BACKGROUND AND SUMMARY

The invention relates to marine drives, and more particularly to a shift cable assembly for a marine drive.

Shift cable assemblies for marine drives typically include a shift actuating arm which is pivoted upon the movement of a remote control by a boat operator between forward, neutral and reverse positions, for example as shown in U.S. Pat. No. 4,753,618, incorporated herein by reference. The present invention arose during continuing development efforts involving the shift cable assembly shown in said patent.

The present invention provides a spring guide assembly having a bidirectional spring providing a slight load in neutral and helping to keep the shift lever in neutral. The spring guide assembly prevents a slow shift and assures and enhances a quick shift out of gear back to neutral. The spring guide assembly also eliminates some chatter of the dog clutch upon shifting into gear. Tho spring guide assembly takes some of the springiness out of the cable attached to the control lever, and takes up backlash and slop of both the cable to the control lever and the cable to the clutch assembly. The invention particularly enhances shifting performance.

DETAILED DESCRIPTION

Figure 1:
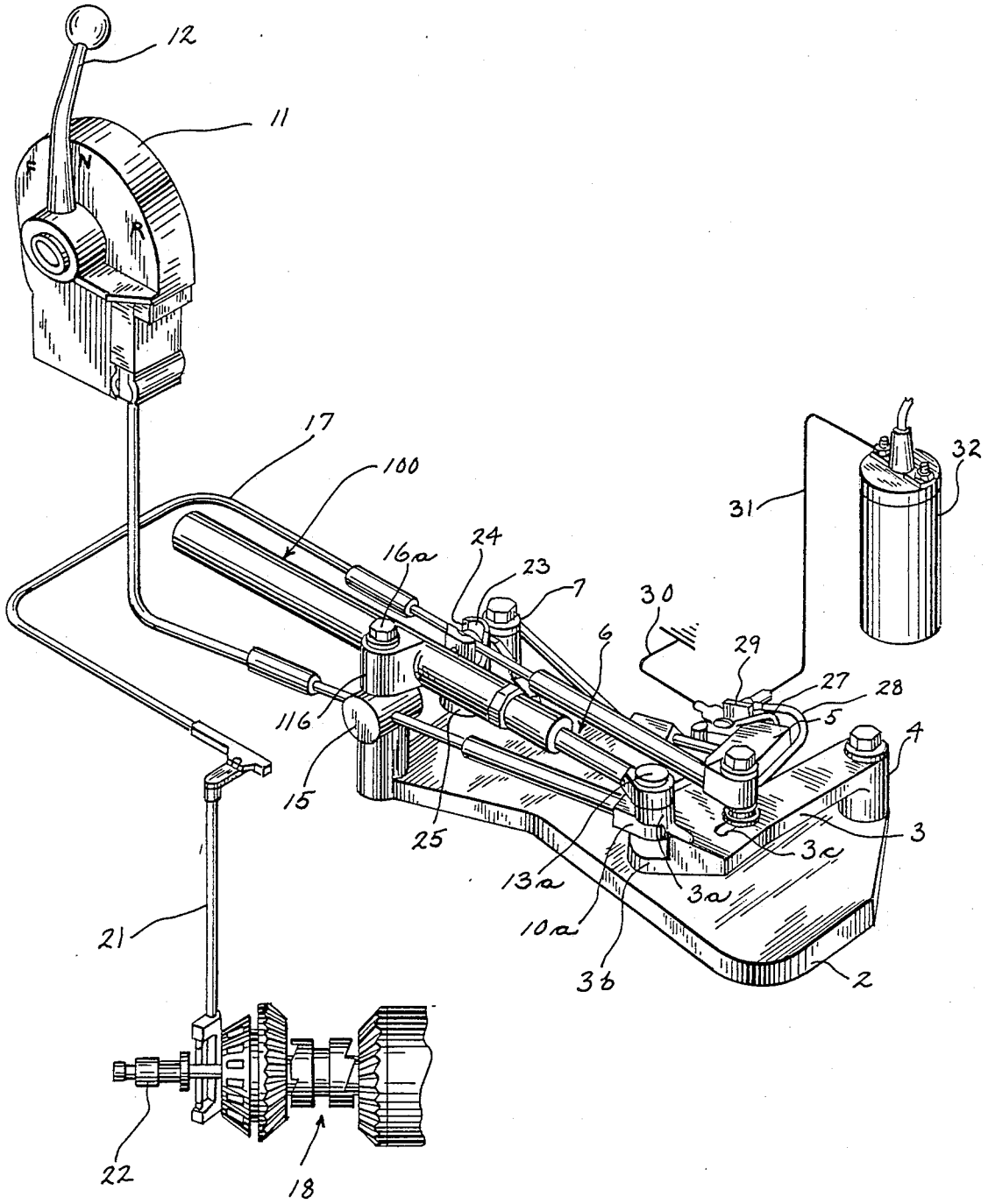
FIG. 1 is a schematic view like that shown in FIG. 1 of incorporated U.S. Pat. No. 4,753,618 and illustrates a shift cable assembly for a marine drive which additionally incorporates a spring guide assembly in accordance with the present invention.
Figure 2:
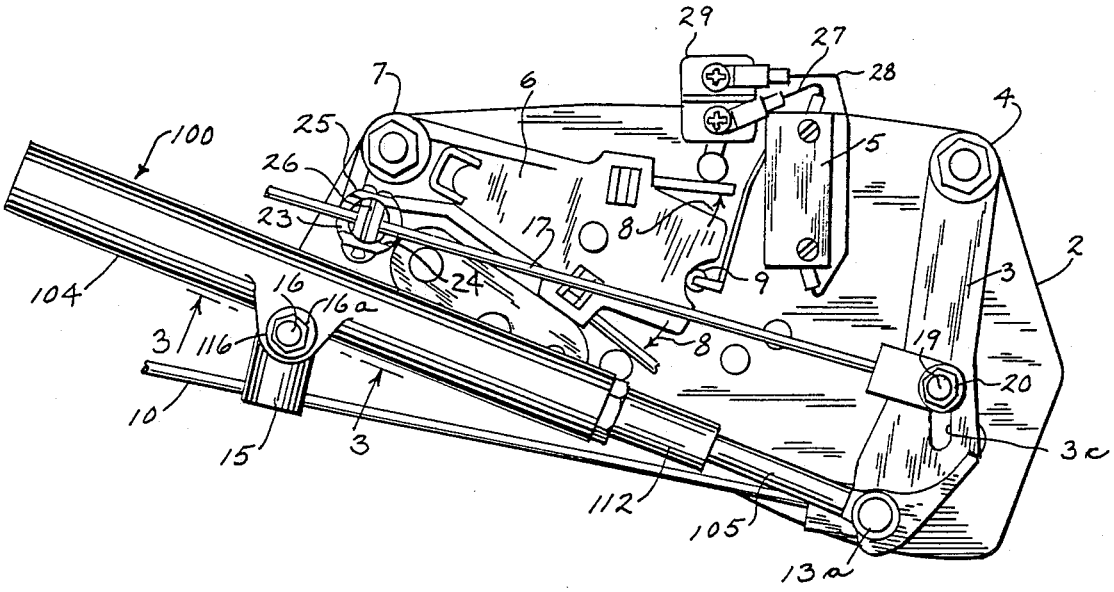
FIG. 2 is an enlarged plan view of the shift plate and spring guide assembly shown in FIG. 1.

The drawings use like reference numerals from incorporated U.S. Pat. No. 4,753,618, where appropriate, to facilitate clarity, and reference is made to said patent for description. FIG. 1 illustrates a shift cable assembly for a marine drive. FIG. 2 illustrates a shift plate assembly 1 incorporated in the shift cable assembly shown in FIG. 1. The shift plate assembly 1 includes a shift plate 2 mounted, for example, at the stern or rear of a boat. A shift lever 3 is pivotally mounted at 4 at one end on plate 2. Shift lever 3 rotates freely about pivot connection 4 with respect to plate 2. Shift plate assembly 1 also includes a shift interrupter switch 5 mounted on plate 2 and actuatable to momentarily interrupt ignition of the drive unit, as will hereinafter be described. A switch actuating arm 6 is pivotally mounted as at 7 on plate 2 adjacent switch 5 between a neutral position as shown in FIGS. 1 and 2, and switching actuating positions on either side of its neutral position, as indicated by arrows 8 in FIG. 2. The pivoting of arm 6 raises a roller 9 connected to switch 5 which in turn closes the contacts within switch 5 to momentarily interrupt ignition of the engine, as will hereinafter be described.

A control cable 10 interconnects a remote control box 11 with shift lever 3. Remote control box 11 is generally located in the front of the boat adjacent the steering wheel (not shown), and includes a shift control arm 12 movable between a forward drive position F, a rearward drive position R and a neutral position N. Control cable 10 has one end connected to arm 12 in control box 11 and its other end connected to the outer or free end of shift lever 3. Cable 10 is connected to the outer end of lever 3 by a stud or anchor clevis pin 13*a*, which also anchors one end of the spring guide assembly 100 of the present invention, to be described. Lever 3 has a fork like portion with tines 3*a* and 3*b* receiving cable end fitting 10*a* therebetween, and FIG. 1 is partially cut away to show same. Clevis pin 13*a* extends downwardly through respective apertures in tine 3*a* cable end fitting 10*a* and tine 3*b*, and a cotter pin (not shown) extends transversely through the lower end of clevis pin 13*a* to retain same on lever 3. An intermediate portion of control cable 10 is also supported by shift plate 2 by means of a guide barrel member 15. Barrel member 15 is cylindrical in shape and includes a radial opening therethrough at one end which slidably receives cable 10. Barrel member 15 also includes a second radial opening extending through its opposite end in a direction transverse to the opening that slidably receives cable 10 which receives a stud or anchor pin 16 projecting from plate 2. A nut 16*a* threadedly engaged and turned down on stud 16 completes anchoring of barrel member 15 on stud 16 and of the spring guide assembly, to be described. Movement of shift arm 12 on remote control box 11 moves cable 10 so as to pivot shift lever 3. Movement of arm 12 from the neutral position N to the forward position F pulls cable 10 toward control box 11 to pivot lever 3 in a clockwise direction. Movement of arm 12 from its neutral position N to its reverse position R pushes cable 10 toward shift plate 2 resulting in shift lever 3 being pivoted in a counterclockwise direction.

A drive cable 17 interconnects shift lever 3, switch actuating arm 6 and a clutch and gear assembly 18 for the marine drive unit. One end of cable 17 is connected to shift lever 3 at a location which is intermediate the opposite ends of lever 3 by means of anchor pin 19 and nut 20. This mounting is the same as that in incorporated U.S. Pat. No. 4,753,618 except that lever 3 includes an elongated slot 3*c* receiving pin 19 and allowing adjustment therealong. The opposite end of cable 17 is attached to a shift shaft 21 which in turn is connected to a shift spool 22 for clutch and gear assembly 18. An intermediate portion of drive cable 17 is also connected or anchored to switch actuating arm 6. This intermediate connection includes a barrel member 23 attached to cable 17 which is received within a slot 24 formed in an upstanding boss 25 projecting from actuating arm 6. A cotter pin 26 extends through the upstanding sides of boss 25 and holds barrel 23 within slot 24. Movement of drive cable 17 by shift lever 3 will result in pivotal movement of switch actuating arm 6 as well as shift spool 22. If shift lever 3 pivots clockwise to push drive cable 17, switch actuating arm 6 will pivot about its connection 7 in a clockwise direction and shift shaft 21 will rotate to move shift spool 22 to cause clutch and gear assembly 18 to move into forward gear. If shift lever 3 pivots in a counterclockwise direction, it pulls drive cable 17 to pivot switch actuating arm 6 about its connection 7 in a counterclockwise direction and moves shift shaft 21 and spool 22 to engage clutch and gear assembly 18 in reverse gear. Movement of shift lever 3 is dependent upon the movement of shift arm 12 of remote control box 11 into the desired forward, neutral or reverse gear.

Pivoting movement of switch actuating arm 6 in either direction, i.e. into either switch actuating position, will raise roller 9 of switch 5 to close the switch contacts within switch 5. Switch 5 in turn is connected via wires 27, 28 to a terminal block 29 which in turn is connected via wire 30 to ground and wire 31 to coil 32 of the ignition system. Thus, the closing of the switch contacts within switch 5 grounds coil 32 so that a momentary interruption in the ignition of the engine results. This momentary interruption in the ignition advantageously "kills" the engine of the marine drive for a short period of time to relieve or reduce the load on the drive gears to enable easier shifting of control shift arm 12 by an operator.

Figure 3:
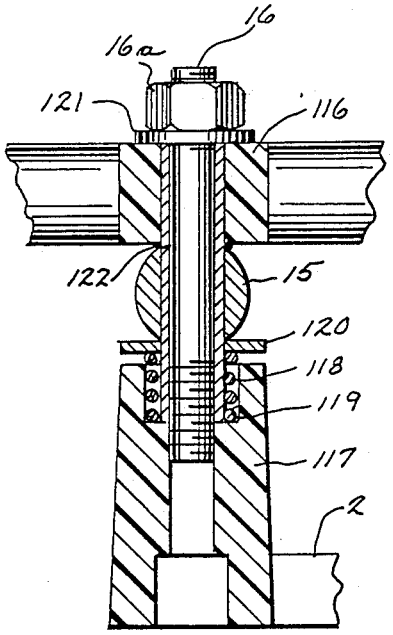
FIG. 3 is a sectional view taken along line 3—3 of FIG. 2.
Figure 7:
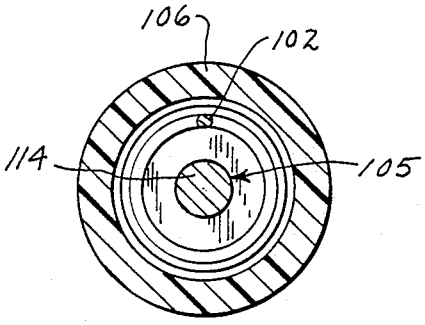
FIG. 7 is a sectional view taken along line 7—7 of FIG. 4.
Figure 4:
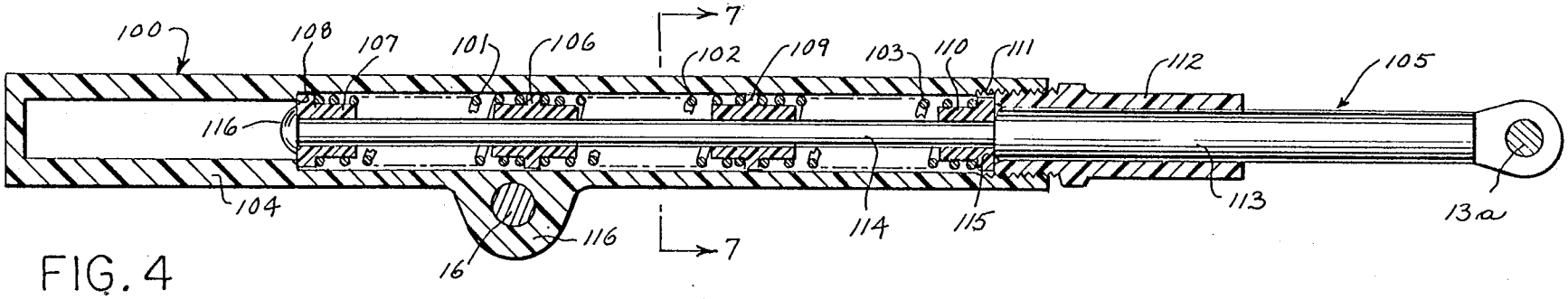
FIG. 4 is a sectional view of the spring guide assembly of FIGS. 1 and 2 and shows the assembly in neutral.

Switch actuating arm 6 is illustrated in detail in FIGS. 3 and 4 of incorporated U.S. Pat. No. 4,753,618, and reference is made thereto for description.

In the present invention, spring guide assembly 100 is coupled to the shift cable assembly and biased to a loaded condition by movement of remote control shift arm 12 from neutral to forward, and is also biased to a loaded condition by movement of remote control shift arm 12 from neutral to reverse, such that the spring bias minimizes chatter of clutch and gear assembly 18 upon shifting into gear, and such that the spring bias aids shifting out of gear and minimizes slow shifting out of gear and returns remote control shift arm 12 to neutral, all with minimum backlash of the cables.

Figure 5:
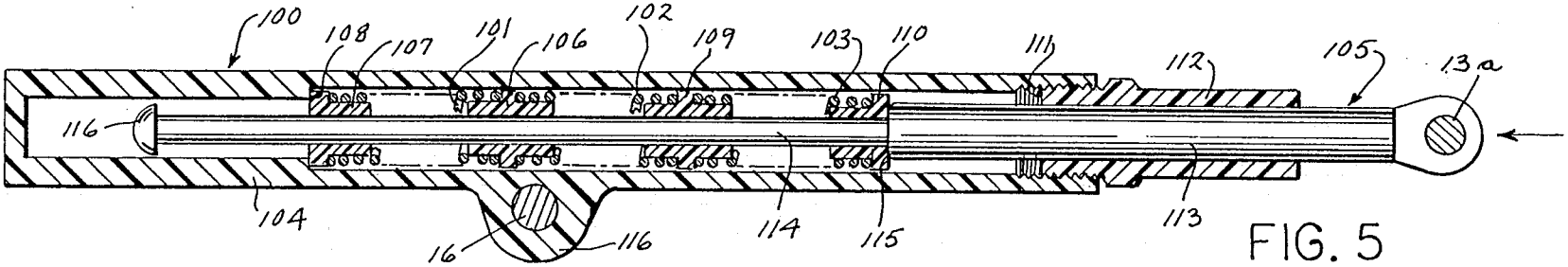
FIG. 5 is a view like FIG. 4 but shows the assembly in the forward gear position with the springs compressed and loaded in one direction.
Figure 6:
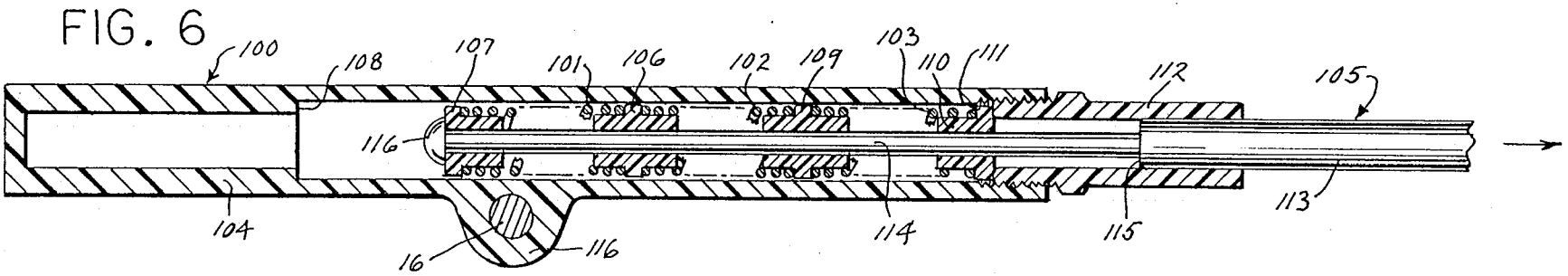
FIG. 6 is a view like FIGS. 4 and 5 but shows the assembly in the reverse gear position with the springs compressed and loaded in the other direction.

Spring guide assembly 100 includes plural compression springs 101, 102, 103, FIG. 4, compressed in one direction, FIG. 5, upon shifting from neutral to forward, and compressed in the opposite direction, FIG. 6, upon shifting from neutral to reverse. The springs are connected in series to reduce the travel stroke of each individual spring and reduce the overall cumulative force as a function of cumulative travel. The use of a single spring is not preferred because of the increasing force required with increasing travel stroke, according to the spring constant. Too high of a force would present an undesirable resistance at the end of the travel stroke upon reaching the forward or reverse position, and hence would provide undesirable increasing force as one shifts into forward or into reverse. In turn, the force at the minimum travel stroke, i.e. in the neutral position, must be kept low enough so that the increasing force with increasing travel stroke into forward or reverse does not become objectionably high. This particular problem is solved by the use of multiple springs which provide a sufficiently high force in the neutral position to enhance quick shifting return to neutral, without presenting an objectionably increasingly high force at the end of the travel stroke upon shifting into forward or reverse.

Spring guide assembly 100 includes an outer tube 104 mounted to shift plate 1 at anchor pin 16, and axially reciprocal plunger 105 mounted to shift lever 3 at anchor pin 13. Springs 101, 102, 103 encircle the plunger within the tube. Spring 101 bears between intermediate floating retainer 106 and left end retainer 107 which in turn is stopped against stop shoulder 108 formed by a step in the inner diameter of tube 104. Spring 102 bears between intermediate floating retainers 106 and 109. Spring 103 bears between retainer 109 and right end retainer 110 which in turn bears against a step shoulder 111 at the inner end of collar 112 which is threaded into tube 104. Plunger 107 has a right portion 113 axially sliding reciprocally through collar 112, and a left portion 114 of reduced diameter forming a step reduction shoulder 115 at the interface with portion 113. Shoulder 115 engages retainer 110 in the neutral position shown in FIG. 4. The left end of left plunger portion 114 has an enlarged head 116 engaging retainer 107 in the neutral position shown in FIG. 4.

Upon shifting from neutral to forward, plunger 105 is retracted leftwardly into tube 104, FIG. 5. During this movement, stop shoulder 115 pushes retainer 110 leftwardly, such that the latter moves out of engagement with stop shoulder 111 in the tube, and springs 101, 102, 103 compress leftwardly. Left end retainer 107 is stopped against stop shoulder 108 in the tube, and head 116 moves leftwardly therefrom. Upon shifting from neutral to reverse, plunger 105 is extended rightwardly out of the tube, FIG. 6, compressing springs 101, 102 and 103 rightwardly During this movement, enlarged head 106 pushes left end retainer 107 rightwardly out of engagement with stop shoulder 108. Right end retainer 110 is stopped against stop shoulder 111 in the tube, and shoulder 115 on the plunger moves rightwardly therefrom. Annular retainers 106 and 107 float along plunger portion 114 between respective adjacent compression springs and equalize the load.

Shift plate 2 includes a cable guide barrel member 15, as noted above, guiding control cable 10 therethrough. Shift cable assembly 100, including tube 104 and plunger 105, are mounted adjacent and above control cable 10 and extend generally parallel thereto. Tube 104 includes an integral mounting flange 116. Anchor pin 16 extends downwardly and is threaded into upstanding boss 117, FIG. 3, on the shift plate. Compression spring 118 in recess 119 in boss 117 upwardly biases annular washer 120 against barrel member 15 against flange 116 against washer 121 below nut **16*a*. This provides a taut connection preventing vibration and rattle. Nut 16*a* is tightened down on washer 121 to engage sleeve 122 around pin 16 such that the bottom of sleeve 122 is tight against the bottom of recess 124**.

It is recognized that various equivalents, alternatives and modifications are possible within the scope of the appended claims.

We claim:

1. A shift cable assembly for a marine drive having a clutch and gear assembly, comprising:

remote control means for selectively positioning said clutch and gear assembly into forward, neutral and reverse gears;

cable means interconnecting said remote control means and said clutch and gear assembly;

biasing means coupled to said cable means and biased to a loaded condition by movement of said remote control means from neutral to forward, and also biased to a loaded condition by movement of said remote control means from neutral to reverse, such that said bias minimizes chatter of said clutch and gear assembly upon shifting into gear, and such that said bias aids shifting out of gear and minimizes slow shifting out of gear and returns said remote control means to neutral, all with minimum backlash of said cable means, wherein said biasing means comprises at least one spring, and wherein a loading force is applied to all of said springs during the shift from neutral to forward, without any unloading force applied to any of said springs during said shift from neutral to forward, and wherein a loading force is applied to all of said springs during the shift from neutral to reverse, without any unloading force applied to any of said springs during said shift from neutral to reverse.

2. The invention according to claim 1 wherein said springs comprise compression springs, all of which compress and shorten during said shift from neutral to forward, and all of which compress and shorten during said shift from neutral to reverse.

3. A shift cable assembly for a marine drive having a clutch and gear assembly, comprising:

remote control means for selectively positioning said clutch and gear assembly into forward, neutral and reverse gears;

cable means interconnecting said remote control means and said clutch and gear assembly;

biasing means coupled to said cable means and biased to a loaded condition by movement of said remote control means from neutral to forward, and also biased to a loaded condition by movement of said remote control means from neutral to reverse, such that said bias minimizes chatter of said clutch and gear assembly upon shifting into gear, and such that said bias aids shifting out of gear and minimizes slow shifting out of gear and returns said remote control means to neutral, all with minimum backlash of said cable means, said biasing means comprises bidirectional compression spring means compressed in one direction upon shifting from neutral to forward, and compressed in the opposite direction upon shifting from neutral to reverse, said spring means comprises plural springs connected in series with a floating retainer between adjacent springs, to reduce the travel stroke of each individual spring and reduce the overall cumulative force as a function of cumulative travel.

4. A shift cable assembly for a marine drive having a clutch and gear assembly, comprising:

a shift plate;

a shift lever pivotally mounted on said plate and pivotable to forward, neutral and reverse positions;

remote control means for selectively positioning said clutch and gear assembly into forward, neutral and reverse gears;

control cable means interconnecting said remote control means and said shift lever and movable by said remote control means to pivot said shift lever to said forward, neutral and reverse positions;

drive cable means interconnecting said shift lever and said clutch and gear assembly;

spring means coupled to said shift lever and biased to a loaded condition by movement of said shift lever from said neutral to said forward position, and also biased to a loaded condition by movement of said shift lever from said neutral to said reverse position, such that said bias minimizes chatter of said clutch and gear assembly upon shifting into gear, and such that said bias aids shifting out of gear and minimizes slow shifting out of gear and returns said remote control means to neutral, all with minimum backlash of said cable means, wherein said spring means comprises at least one spring and wherein a loading force is applied to all of said spring during the shift from neutral to forward, without any unloading force applied to any of said spring during said shift from neutral to forward, and wherein a loading force is applied to all of said springs during the shift from neutral to reverse, without any unloading force applied to any of said springs during said shift from neutral to reverse, said springs comprise compression springs, all of which compress and shorten during said shift from neutral to forward, and all of which compress and shorten during said shift from neutral to reverse.

5. The invention according to claim 4 wherein said spring means is connected between said shift lever and said shift plate.

6. The invention according to claim 5 wherein said spring means comprises a spring biased plunger axially reciprocal in an outer tube, wherein one of said plunger and said tube is mounted to said shift lever, and the other of said plunger and said tube is mounted to said shift plate.

7. The invention according to claim 6 comprising bidirectional compression spring means within said tube and encircling said plunger and compressed in one direction upon movement of said shift lever retracting said plunger into said tube and corresponding to one of said forward and reverse positions, and compressed in the opposite direction upon movement of said shift lever extending said plunger out of said tube and corresponding to the other of said forward and reverse positions, first and second stops fixed within said tube at opposite ends of said bidirectional compression spring means, first and second stops fixed on said plunger at opposite ends of said bidirectional compression spring means, such that upon retraction of said plunger into said tube, said second stop on said plunger moves in said one direction and causes compression of said compression spring means in said one direction against said first stop in said tube, and such that upon extension of said plunger out of said tube, said first stop on said plunger moves in said opposite direction and causes compression of said compression spring means in said opposite direction against said second stop in said tube.

8. A shift cable assembly for a marine drive having a clutch and gear assembly, comprising:

a shift plate;

a shift lever pivotally mounted on said plate and pivotable to forward, neutral and reverse positions;

remote control means for selectively positioning said clutch and gear assembly into forward, neutral and reverse gears;

control cable means interconnecting said remote control means and said shift lever and movable by said remote control means to pivot said shift lever to said forward, neutral and reverse positions;

drive cable means interconnecting said shift lever and said clutch and gear assembly;

spring means coupled to said shift lever and biased to a loaded condition by movement of said shift lever from said neutral to said forward position, and also biased to a loaded condition by movement of said shift lever from said neutral to said reverse position, such that said bias minimizes chatter of said clutch and gear assembly upon shifting into gear, and such that said bias aids shifting out of gear and minimizes slow shifting out of gear and returns said remote control means to neutral, all with minimum backlash of said cable means, wherein said spring means is connected between said shift lever and said shift plate, wherein said spring means comprises a spring biased plunger axially reciprocal in an outer tube, wherein one of said plunger and said tube is mounted to said shift lever, and the other of said plunger and said tube is mounted to said shift plate, and comprising bidirectional compression spring means within said tube and encircling said plunger and compressed in one direction upon movement of said shift lever retracting said plunger into said tube and corresponding to one of said forward and reverse positions, and compressed in the opposite direction upon movement of said shift lever extending said plunger out of said tube and corresponding to the other of said forward and reverse positions, first and second retainers encircling said plunger at opposite ends of said bidirectional compression spring means therebetween and axially slidable along said plunger, first and second steps fixed on said plunger at opposite ends of said bidirectional compression spring means and said retainers, first and second stops fixed within said tube at opposite ends of said bidirectional compression spring means and said retainers, such that retraction of said plunger into said tube causes said first stop on said plunger to move in said one direction away from said first retainer and causes said second stop on said plunger to push said second retainer to compress said compression spring means in said one direction against said first retainer which is stopped against said first stop in said tube, and such that extension of said plunger out of said tube causes said second stop on said plunger to move in said opposite direction away from said second retainer and causes said first stop on said plunger to push said first retainer to compress said compression spring means in said opposite direction against said second retainer which is stopped against said second stop in said tube.

9. The invention according to claim 8, wherein said compression spring means comprises a plurality of compression springs axially spaced along said plunger and separated by an annular floating retainer between adjacent springs, said retainer being axially slidable along said plunger and axially spacing adjacent compression springs bearing oppositely thereagainst.

10. A shift cable assembly for a marine drive having a clutch and gear assembly, comprising:

a shift plate;

a shift lever pivotally mounted on said plate and pivotable to forward, neutral and reverse positions;

remote control means for selectively positioning said clutch and gear assembly into forward, neutral and reverse gears;

control cable means interconnecting said remote control means and said shift lever and movable by said remote control means to pivot said shift lever to said forward, neutral and reverse positions;

drive cable means interconnecting said shift lever and said clutch and gear assembly;

spring means coupled to said shift lever and biased to a loaded condition by movement of said shift lever from said neutral to said forward position, and also biased to a loaded condition by movement of said shift lever from said neutral to said reverse position, such that said bias minimizes chatter of said clutch and gear assembly upon shifting into gear, and such that said bias aids shifting out of gear and minimizes slow shifting out of gear and returns said remote control means to neutral, all with minimum backlash of said cable means, wherein:

said spring means is connected between said shift lever and said shift plate;

said spring means comprises a spring biased plunger axially reciprocal in an outer tube, wherein one of said plunger and said tube is mounted to said shift lever, and the other of said plunger and said tube is mounted to said shift plate;

said shift plate includes a cable guide guiding said control cable means therethrough, said control cable means has an end connected to said shift lever, said plunger and tube are mounted adjacent said control cable means and extend generally parallel thereto, one of said plunger and rod being connected to said guide, and the other of said plunger and rod being connected to said shaft lever at said end of said control cable means.

* * * * *